US005109343A

United States Patent [19]

Budway

[11] Patent Number: 5,109,343

[45] Date of Patent: Apr. 28, 1992

[54] METHOD AND APPARATUS FOR VERIFICATION OF RAIL BRAKING DISTANCES

[75] Inventor: Raymond J. Budway, Pittsburgh, Pa.

[73] Assignee: Union Switch & Signal Inc., Pittsburgh, Pa.

[21] Appl. No.: 534,050

[22] Filed: Jun. 6, 1990

[51] Int. Cl.[5] ..... B61L 3/00; B61K 9/08

[52] U.S. Cl. ..... 364/426.05; 73/490; 246/177; 246/182 C; 246/184; 246/185; 364/424.04; 364/426.01; 364/561; 364/578

[58] Field of Search ..... 364/426.05, 426.01, 364/424.04, 424.02, 550, 551.01, 561, 562, 565, 566, 578, 579; 246/14, 15, 20, 23, 122 R, 167 R, 177, 182 R, 182 A, 182 B, 184, 185, 187 R, 187 B, 187 A, 217, 218, 477; 303/20, 22.6; 73/488, 490

[56] References Cited

U.S. PATENT DOCUMENTS

| | | | |
|---|---|---|---|
| 2,340,403 | 2/1944 | Morley et al. | 73/490 X |
| 4,057,712 | 11/1977 | Sakakibara et al. | 73/490 X |
| 4,181,943 | 1/1980 | Mercer, Sr. et al. | 364/426.05 |
| 4,234,922 | 11/1980 | Wilde et al. | 246/182 R X |
| 4,241,403 | 12/1980 | Schultz | 364/424.04 X |
| 4,279,395 | 7/1981 | Boggio et al. | 364/426.05 X |
| 4,302,811 | 11/1981 | McElhenny | 364/426.05 |
| 4,495,578 | 1/1985 | Sibley et al. | 364/426.05 |
| 4,561,057 | 12/1985 | Haley, Jr. et al. | 364/424.04 X |
| 4,853,883 | 8/1989 | Nickles et al. | 364/578 |

*Primary Examiner*—Parshotam S. Lall
*Assistant Examiner*—E. J. Pipala
*Attorney, Agent, or Firm*—Buchanan Ingersoll

[57] ABSTRACT

A braking distance verification system is disclosed which makes use of a specially designed pulse to voltage converter circuit and a portable computer-based data acquisition system to measure grade, speed, and distance information of any rail vehicle. The preferred embodiment of the device is particularly adapted for mass transit systems. It provides a method and apparatus for physical verification, under actual test conditions, that an adequate braking distance has been provided in each block of a signal block design system. The portable system may be used with any vehicle braking system which provides an electronic wheel tachometer or equivalent, or may utilize a portable doppler radar if tachometer information is not available.

27 Claims, 3 Drawing Sheets

METHOD AND APPARATUS FOR VERIFICATION OF RAIL BRAKING DISTANCES

BACKGROUND OF THE INVENTION

1. Field of the Invention

The present invention relates to a method and apparatus for verifying if a train block signal system is properly designed. More specifically, the invention relates to a method and apparatus for verifying if the actual braking distance of a train moving under specified conditions is less than or equal to the estimate utilized in creating the block design.

2. Description of the Prior Art

The movement of trains along a train track is classified as having a "single degree of freedom," i.e., the train may move only backwards or forwards on the track. In order for the railroad to operate efficiently and cost-effectively, it must maximize the number of trains running along a given section of track during a given period of time. At the same time, safety considerations regulate the ability of the railroad to have trains running in opposite directions. or narrowly spaced apart in the same direction, along this section of track. In order to compromise and achieve maximum utility from the equipment without risk to the operators passengers and freight carried by the train, a system of signaling and braking has been developed.

The signalling system is based on the concept of "blocks." A length of train track is divided into sections, identified as blocks. Signals are provided at the entrance to each block, indicating whether the block ahead is clear for the train to continue. Additionally, the rate that the train may move through the block is displayed. In order to provide further advance warning of block conditions, signals may be posted several blocks in advance, coupled with a clear system identifying which signals are associated with which blocks.

The blocks are laid out by considering the condition of the terrain and the stopping distance of the trains passing through the block. Of course, terrain conditions directly affect the trains' ability to stop. By carefully calculating the length of the blocks and providing proper signalling, the amount and speed of traffic along a stretch of track can be greatly increased from a bare section through which only one train can pass at a time.

As previously mentioned, the critical parameter in block design is the stopping distance of the trains which will pass through the block. The entire system is premised on the condition that the train, given a signal at the entrance to the block, can stop within the block. Another precondition is that the train must be travelling at the proper speed when entering the block. It is therefore necessary to test each block under operating conditions to determine whether a train can stop therein.

As currently practiced, the testing of each block is a long and laborious process. A representative train is outfitted with cargo and placed on the track to be tested. The track is cleared to avoid any collisions. The train is then taken up to speed prior to the entry to the block in question. After entering the block, the train's brakes are engaged for a full service application. The train then comes to a halt. If the train is past the end of the block, the block is obviously too short. If the train is still within the block, the distance to the end of the block is measured. This is then compared to a standard to determine if the cushion between the train and the end of the block is large enough. During this operation, the train may be outfitted with a graphic recorder of its speed and motion to assist in later calculations of movement and distances. In any case, the process is laborious in that the speed and distances must be manually calculated from this data. Furthermore, each block must be individually tested.

There exists, therefore, a need in the art for a computer operated system which can automatically track the speed and motion of the train, and furthermore calculate the cushion between the end of the block and the train. This data could the be compared to the standard, which is also input to the computer, and a numerical and graphic result would demonstrate the operability of the track and block design for service.

SUMMARY OF THE INVENTION

A computerized system is disclosed which utilizes the block design data to track the stopping movement of a train through a signalling block. The device makes use of a specially designed pulse to voltage converter circuit and a portable computer based data acquisition system. It measures grade, speed, and distance information of any vehicle for the purpose of verifying that adequate braking distance has been provided in the signal block design for train systems.

The portable system may be used with any vehicle braking system which provides an electronic wheel tachometer or its equivalent. A second embodiment utilizes a portable doppler radar if tachometer information is not available. The system uses a portable digital computer and a standard input/output (I/O) interface to receive standard tachometer or radar pulse type data for the purpose of displaying the speed and distance of the vehicle, and performing the required analysis which determines whether the block design is adequate for safe braking.

These and other advantages and features of the present invention will be more fully understood with reference to the presently preferred embodiments thereof and to the appended drawings.

DESCRIPTION OF THE PREFERRED EMBODIMENTS

Figure 1:
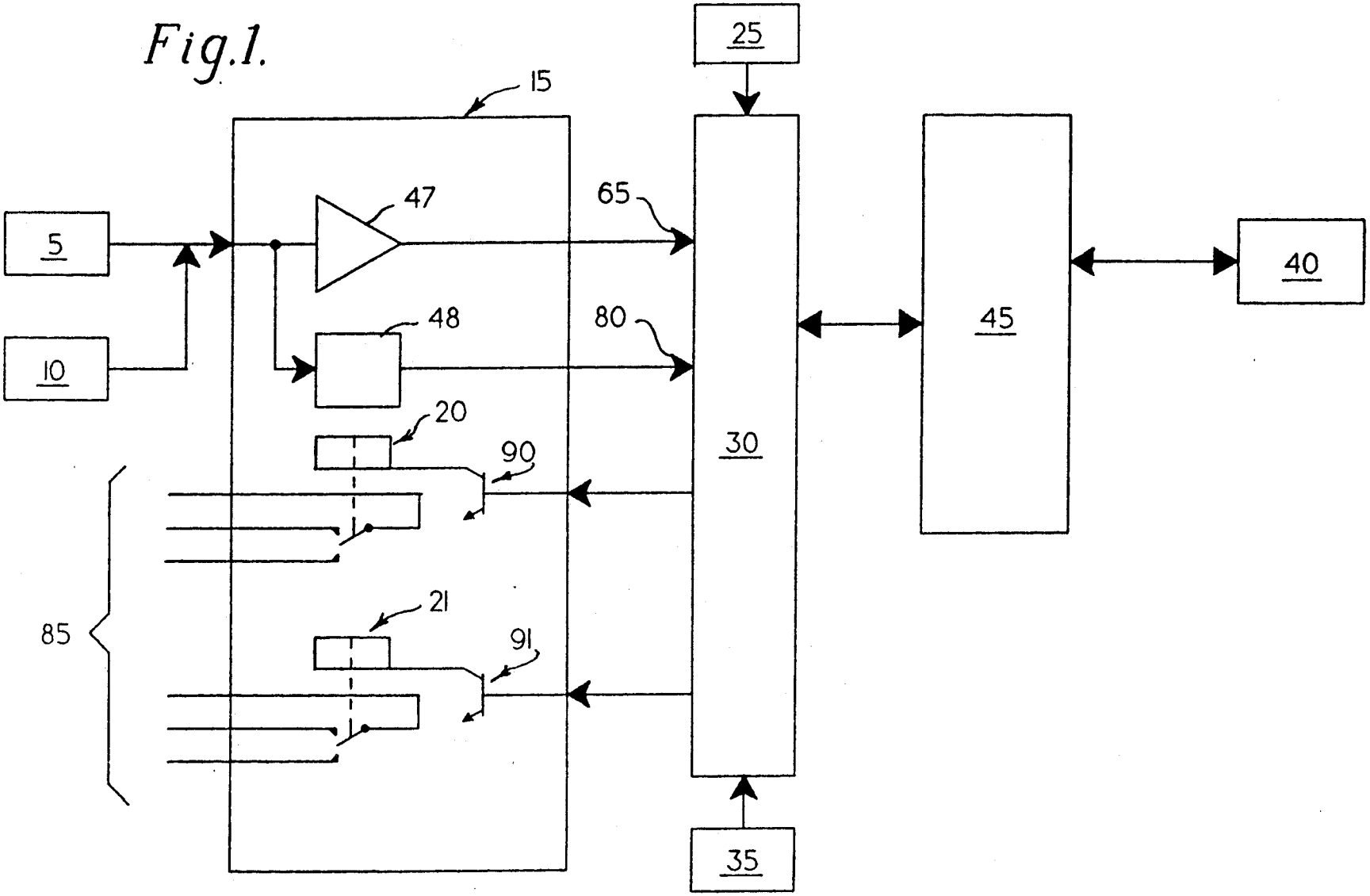
FIG. 1 is a block diagram of the components of the verification system.

The system is generally applicable to all rail vehicles. The preferred embodiment is specifically adapted for the electro-pneumatic braking systems commonly utilized in mass transit systems. FIG. 1 is a functional block diagram of the system which shows the general interrelationship between the sections. Pulse inputs from either the vehicle's tachometer 5 or from a doppler radar 10 are fed to the interface circuit board 15. In the interface circuit board 15, the pulses are suitably shaped and amplified for the distance travelled to be measured, and also converted to a voltage proportional to the pulse frequency from which the vehicle's speed may be determined. First and second relays 20 and 21, respectively, provide brake commands to the vehicle's electronic braking system.

A clinometer input 25 is provided to the termination circuit 30. The clinometer is preferably of high accuracy to detect changes of .1° in grade or acceleration. The clinometer input 25 is comprised of angular measurements from which the track grade and the acceleration of the train on the grade is measured. The clinometer is a commercially available unit, having a D.C. voltage output proportional to the angular displacement of the device.

An automatic trigger 35 for automatically stopping and starting the testing may optionally be provided. This is preferably an infra-red detector. The trigger 35 preferably consists of a number of parallel normally open dry contacts. Alternatively, +5 volts D.C. may be provided to automatically start and stop the test run. A switch 36 is provided in series with the trigger inputs to disable this circuit when desired.

The termination circuit 30 is of conventional design and passes data to a computer 40 by analog and digital input/output (I/O). The computer is preferably a laptop or other portable model. A standard interface I/O card 45 is utilized to pass the data into the data bus of computer 40. Power for the system is delivered at power supply feed 37 from an external conventional power source (not shown).

Figure 2:
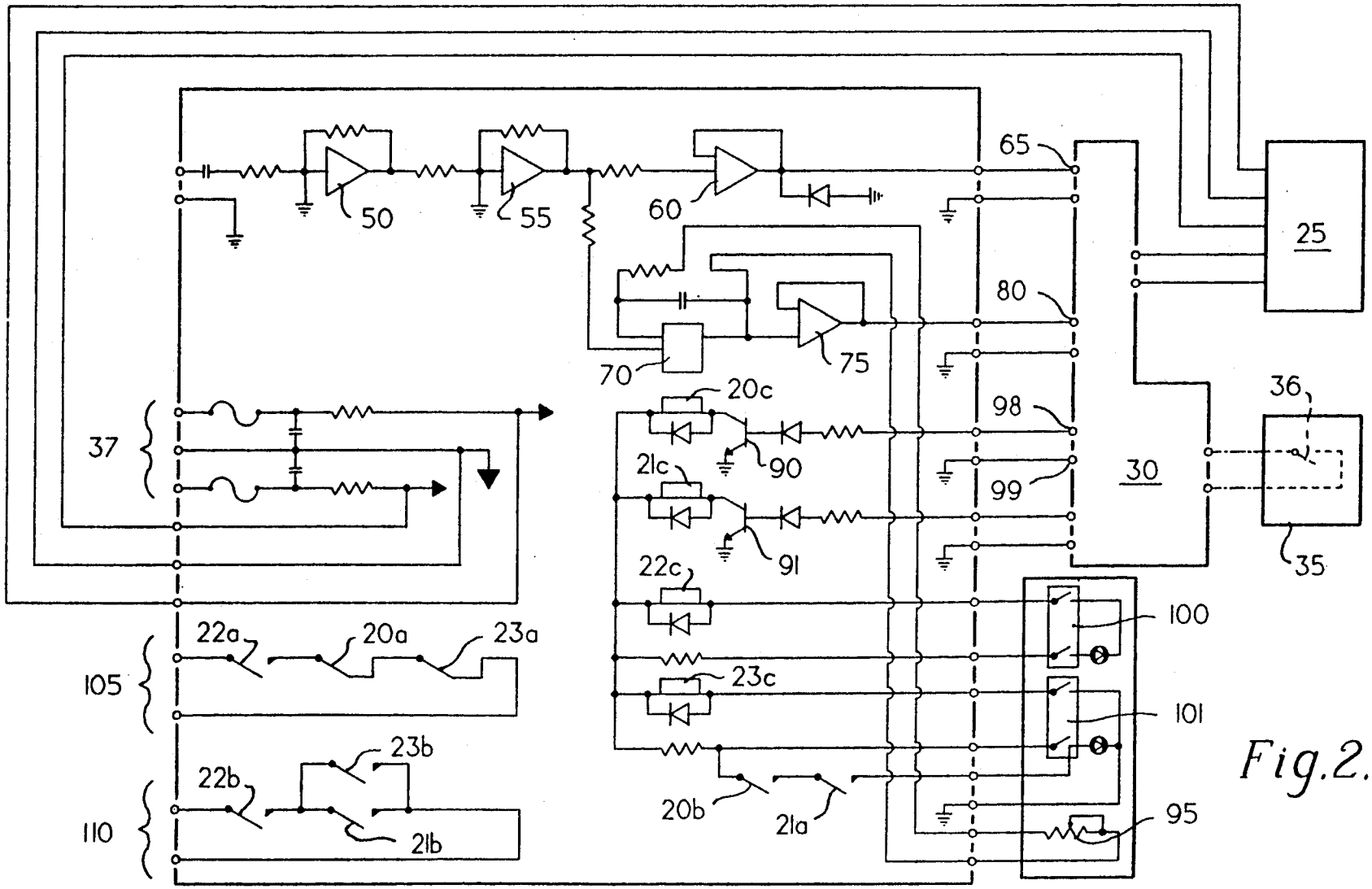
FIG. 2 is a schematic diagram of the verification system's electrical circuit.

The interface circuit board 15 is shown with more detail in the schematic of FIG. 2. The first function of the interface circuit 15 is to accept pulses and current frequency data from the vehicle's wheel tachometer or an equivalent source from which speed and distance are derived. This pulse data computation circuit 47 is shown graphically in FIG. 1. The pulses are amplified and shaped for suitable input to a pulse counter, and also converted to a D.C. voltage which is proportional to the pulse frequency. Referring to FIG. 2, the pulse data computation circuit 47 is shown as follows: first amplifier circuit 50 is an A.C. coupled amplifier used to block D.C. current from the source and to provide sufficient gain to drive second amplifier circuit 55. Second amplifier circuit 55 is a D.C. amplifier which preferably has a nominal gain of 15 volts. This is sufficient to drive the amplifier into saturation. Third amplifier circuit 60 is a voltage follower whose output is preferably clamped at −.2 volts. The output from third amplifier circuit 60 is delivered to a pulse counter which is connected by a pulse counter input 65 to the termination circuit 30, as also shown in FIG. 1.

A frequency conversion circuit 48 is graphically represented in FIG. 1. More detail of the circuit is shown in FIG. 2. The output of second amplifier circuit 55 is also delivered to a frequency to voltage converter 70 whose output is a D.C. voltage proportional to the frequency of the input. The output of the frequency to voltage converter 70 is then delivered to fourth amplifier circuit 75, which functions as a voltage follower. The output of fourth amplifier circuit 75 is delivered to the termination circuit 30 through frequency input 80, is also shown in FIG. 1. This data is then passed as an analog signal to the computer 40. A variable resistor is provided as a potentiometer 95 which is used to calibrate the frequency to voltage converter 70.

The interface circuit board 15 also contains a brake control section 85, as shown in FIG. 1. FIG. 2 illustrates this circuit in more detail. First, second, third and fourth relay contacts 20*a,b*, 21*a,b*, 22*a,b*, and 23*a,b*, respectively, provide the interface to the brake control lines which permits the brakes to be controlled by the brake verification system. The contacts of these relays ar circuited to simultaneously remove the brake propulsion current and to apply a brake rate consistent with the desired brake application rate.

Relay coils 20*c*, 21*c*, 22*c*, and 23*c* are activated by signals from first and second transistor drivers 90 and 91, these transistor drivers are switched by the computer 40 through first and second digital outputs 98 and 99. First and second switches 100 and 101 are manual switches which control third an-d fourth relay coils 22*c* and 23*c*, respectively. Enabling first switch 100 permits the brake verification system to have control of the brakes during the tests, while enabling second switch 101 allows the operator of the system to apply the brakes manually if required. Disabling first switch 100 relay prevents the system from controlling the vehicle's brakes. The brake system propulsion current is controlled through the brake line circuit 105 utilizing third, first and fourth relay contacts 22*a*, 20*a*, and 23*a*, respectively. The brake rate is controlled through the brake rate circuit 110, utilizing third, second and fourth relay contacts 22*a*, 21*b*, and 23*b*, respectively.

In operation, the brake verification system utilizes a file generated by the block design program to generate control line data files suitable for its use. This data generally contains the following information in numerical form: a record number indicating each block record, a positional value for the entrance to the approach track section, a positional value for the transition between the approach track and the entrance to the test block, a positional value for the exit of the test block, the test block length, the predicted average applied brake rate of the vehicle to be utilized for testing, the maximum allowable speed for the vehicle, the predicted maximum speed of the vehicle under worst case conditions, a distance value for the displacement of the moving vehicle during the predicted reaction time of the operator, the predicted stopping distance of the vehicle using the given brake application rate and a distance value for the predicted buffer or cushion remaining in the test block after the vehicle has stopped. A record is generated for each train length expected to be utilized on the block.

The wheel diameter of the test vehicle must also be calculated. A program which utilizes data from the tachometer may be provided to make this calculation automatically.

The verification program generates a data file which may be used to either reconstruct the actual test results and display them on a monitor for review, or for analysis, which not only reconstructs the test for display, but also calculates a new braking profile after removing the anomalies that may result from the motorman's errors in operating the vehicle. Hard copies of all data and output may be created by conventional means.

The operation is initiated by entering car parameter data and other information required by the program for subsequent processing. On program startup a menu appears on the display requiring specific inputs before the program can resume. These inputs include train type, train length, wheel diameter, gear ratio, car overhang and reaction time. The test file parameter permits the selection of the proper block data.

Figure 3:
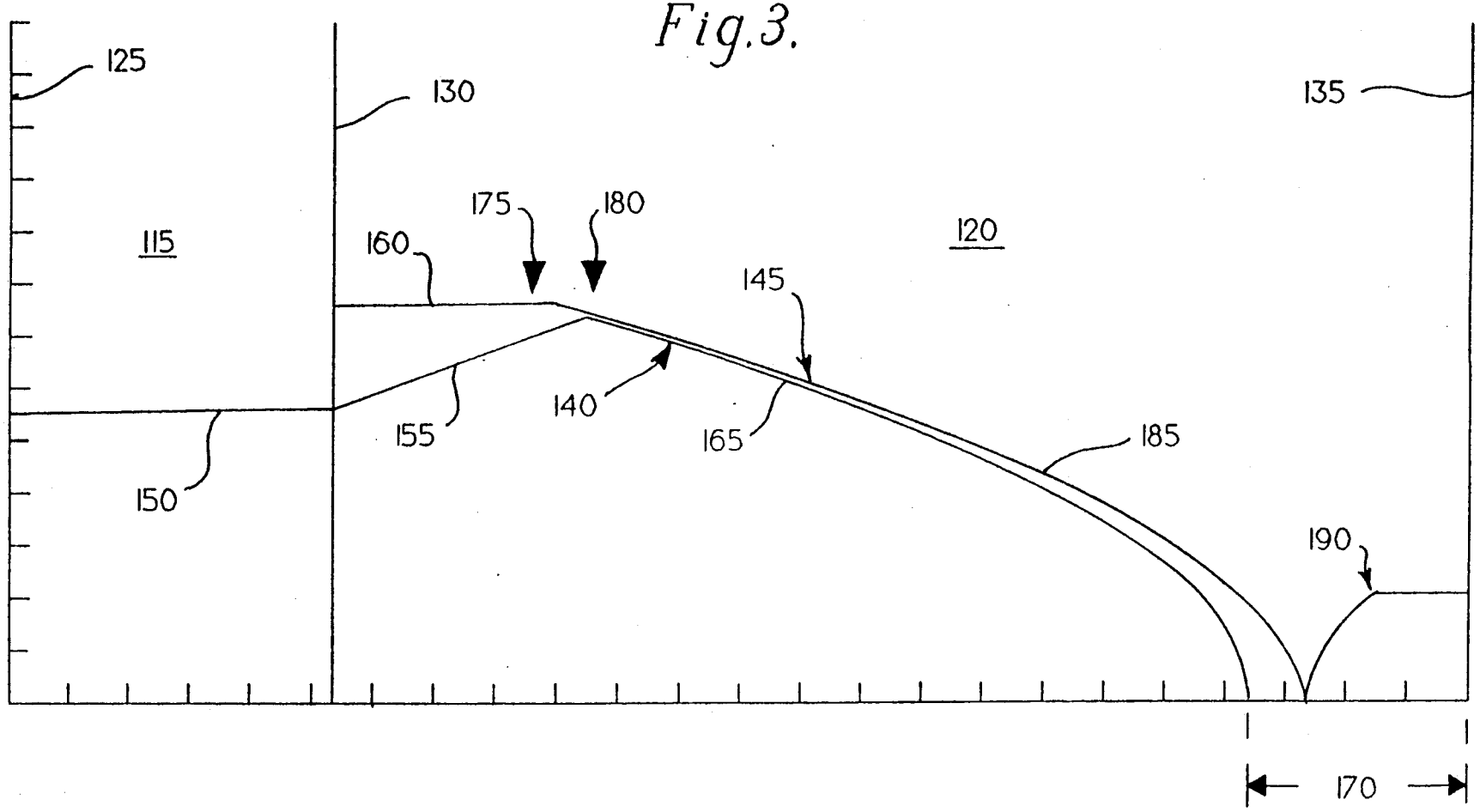
FIG. 3 is the graphic display showing a sample train test.

After the initial data input is completed, the operator is prompted for the record number of the control line to be tested. The record number allows the system to access the correct block design data for the test block. A graphical representation of the calculated braking profile for that control zone is also displayed on the monitor of computer 40 for the convenience of the operator. A typical graphical display is shown in FIG. 3. The system tracks the position of the approach and test blocks and illustrates this data of the display. The display is divided into an approach section 115 and a test section 120. The approach section 115 is bounded by first positional line 125, corresponding to the positional value for the entrance to the approach track section, and second positional line 130, corresponding to the positional value for the transition between the approach track and the entrance to the test block. The test section 120 is bounded by second positional line 130 and third positional line 135, which corresponds to the positional value for the exit of the test block.

The system utilizes two sets of data, shown as two lines on the display: predicted train braking curve 140 and actual train braking curve 145. The predicted approach velocity 150 is calculated and displayed for the approach section 115. This represents the maximum speed allowable for the vehicle under the specified test conditions. The predicted train braking curve 140 in test section 120 is calculated to represent the predicted speed profile of the test vehicle under worst case conditions. Predicted reaction segment 155 represents the predicted distance calculated for the travel of the vehicle during the reaction time of the operator and system before any brakes could be applied. Predicted stopping segment 165 represents the calculated distance the vehicle would travel using the brake application rate specified for the test. Predicted buffer distance 170 is the distance calculated to be remaining at the end of the block section under worst case conditions.

The vehicle's speed and the absolute value of acceleration are continuously monitored and displayed as actual train braking curve 145. The brake verification phase is triggered either by operator input or by providing a voltage ground to the interface input. This begins the monitoring of the vehicle's progress through the test zone which is displayed as curve 145. The speed, distance, time and grade calculations derived from the program may optionally be displayed simultaneously o the monitor of the computer 40.

The actual performance of the test vehicle is monitored by the system and illustrated by actual train braking curve 145. Initial velocity segment 160 represents the measured speed at which the test vehicle entered the test block. Brake command point 175 denotes the relative time point of the braking command whether manually or computer generated. The accurate numerical values for the speed and distance at which the brake command is given may also be displayed for the convenience of the operator (not shown). Brake actuation point 180 represents the relative time point of the brake application. As with the command, the numerical values for speed and distance at which brakes are applied may also be displayed (not shown). Actual stopping curve 185 illustrates the monitored deceleration of the test vehicle over distance.

After the vehicle has stopped, the measurement of the buffer distance is initiated by the operator. The numerical value of the calculated distance remaining in the block may be displayed on the monitor of the computer 40. This value may be checked by actually running the vehicle through the remainder of the test block. This measured distance is illustrated by buffer segment 190. The measurement is ended either manually, or automatically by providing a pulse to automatic trigger 35 at the termination point of the test block. The continuously measured speed, distance, and clinometer data for the vehicle may be stored for subsequent analysis and recreation of the test. The data is preferably sampled and stored approximately every five feet at low speeds and approximately every 50 feet at higher speeds.

Although not an integral part of the system, means are provided for the calibration of the tachometer wheel, for use before each series of tests are run. The wheel diameter is calibrated when a tachometer system is used for the movement data input. The following equation is utilized:

$$\text{Wheel Diameter} = \frac{D \times k_t \times k_g \times 24}{N \times \pi}$$

where:

D is the known test distance in feet;

$k_t$ is the number of teeth per tachometer ring;

$k_g$ is the gear ratio of wheel to tachometer ring; and

N is the number of pulses delivered to the system. N is measured by the system, while $k_t$, $k_g$, and D are known fixed quantities. Thus, application of the above equation will yield a correct value of the wheel diameter which is to be used as input to the program.

While I have described a present preferred embodiment of the invention, it is to be distinctly understood that the invention is not limited thereto but may be otherwise embodied and practiced within the scope of the following claims.

I claim:

1. An apparatus for determining the stopping distance of a railway vehicle comprising:

means for sensing the position of the railway vehicle on a given length of track;

speed detection means connected to said position sensing means, for detecting the rate of change of the position of the railway vehicle over time;

means for applying a braking force to the railway vehicle connected to said position sensing means, for applying the brakes of the railway vehicle at a preselected first position; and distance calculation means connected to said position sensing means for calculating the distance between said first position and a second position, said second position being located subsequent to said first position, when the speed detection means indicates the railway vehicle is stopped.

2. An apparatus as described in claim 1, wherein said first position is determined from the location of a signalling device on the track.

3. An apparatus as described in claim 2, wherein said signalling device is an infrared transmitter.

4. An apparatus as described in claim 1, wherein said first position is determined by an operator of the railway vehicle.

5. An apparatus as described in claim 1, wherein said position sensing means is a doppler radar device mounted on said railway vehicle.

6. An apparatus as described in claim 1, wherein said position sensing means further comprises a tachometer which detects the revolutions of the wheels of the railway vehicle.

7. An apparatus as described in claim 6, wherein said position sensing means is a pulse counting device which counts pulse output of said tachometer.

8. An apparatus as described in claim 1, wherein said second position is within a predetermined block of said length of track.

9. An apparatus as described in claim 8, wherein the railway vehicle stopping characteristics of said predetermined block have been determined by a computerized block layout program.

10. An apparatus as described in claim 9, further comprising means for measuring the distance between the second position of the railway vehicle and the end of a signal block containing said second position.

11. An apparatus as described in claim 9, wherein said computerized block layout program generates a calculated stopping distance of a railway vehicle having certain characteristics within that predetermined block.

12. An apparatus as described in claim 11, further comprising comparison means for comparing said calculated stopping distance with the stopping distance as measured by the apparatus.

13. An apparatus as described in claim 1, wherein the output of said speed detection means of the railway vehicle is periodically stored.

14. An apparatus as described in claim 1, further comprising inclination sensing means, for determining the angle of the railway vehicle with respect to the horizontal.

15. An apparatus as described in claim 14, wherein said inclination sensing means is utilized in calculating an acceleration of the railway vehicle on the track.

16. An apparatus as described in claim 1, wherein said brakes of the railway vehicle may be operated manually between the first and second positions.

17. An apparatus as described in claim 1, further comprising means for determining the diameter of the wheels of the railway vehicle.

18. An apparatus as described in claim 1, further comprising display means for displaying the position of the railway vehicle in the block.

19. An apparatus as described in claim 18, wherein the display means is adapted to simultaneously display predetermined computer-calculated data for the position of the railway vehicle and the actual position of the railway vehicle during the determination of its stopping distance.

20. An apparatus as described in claim 1, wherein said distance calculations are continuously stored in such a fashion to allow display of said distance calculations at a later time.

21. A method for measuring the stopping distance of a railway vehicle comprising the steps of:

sensing a first position of the railway vehicle on a given length of track;

detecting the rate of change of the position of the railway vehicle over time;

applying a braking force to the railway vehicle at a preselected location; and calculating the distance between the first position, being a position when the brakes are applied, and a second position, being that subsequent to said application of the brakes, when the rate of change of the position of the railway vehicle over time is detected as zero.

22. A method for measuring the stopping distance of a railway vehicle as described in claim 21, wherein the first and second positions are within a predetermined test block.

23. A method for measuring the stopping distance of a railway vehicle as described in claim 22, wherein said predetermined block has been predetermined by a computerized block layout program.

24. A method for measuring the stopping distance of a railway vehicle as described in claim 23, wherein said computerized block layout program has also calculated the stopping distance of a railway vehicle having certain weight characteristics within that predetermined block.

25. A method for measuring the stopping distance of a railway vehicle as described in claim 24, further comprising the step of comparing said calculated stopping distance with the actual stopping distance as measured by the apparatus.

26. A method for measuring the stopping distance of a railway vehicle as described in claim 25, further comprising the step of measuring the distance in the block between the second position of the railway vehicle, the second position being that where the railway vehicle has stopped, and the end of the block.

27. A device for operation of a railway vehicle braking system and simultaneous measurement of the braking distance of said railway vehicle under the control of said device for numerical and visual verification that said braking distance is within a preselected braking distance based on computergenerated data, the device comprising:

speed measurement means adapted to measure the velocity of said railway vehicle;

inclination measurement means;

at least one electrically operated relay adapted to engage said braking system of said railway vehicle when activated;

amplification circuitry means, electronically connected to said speed measurement means, said circuitry means adapted to convert the output of the speed measurement means into:

i) a first signal having a frequency proportionate to the velocity of said railway vehicle;

ii) a second signal having a voltage proportionate to the velocity of said railway vehicle;

interface circuit means, electronically connected to said amplification circuitry means, said at least one relay and said inclination measurement means, said interface circuit means adapted for data transfer therebetween; and a computer, electronically connected to said interface circuit means, adapted to receive said first and second signals, activate at least one relay to engage the braking system of the railway vehicle, display a first velocity profile based on said computergenerated data and further calculate and display a second velocity profile such that said first and second velocity profiles may be numerically and visually compared.

* * * * *